United States Patent [19]

Metge

[11] 4,055,052

[45] Oct. 25, 1977

[54] ARCTIC ISLAND

[75] Inventor: Michel Metge, Calgary, Canada

[73] Assignee: Exxon Production Research Company, Houston, Tex.

[21] Appl. No.: 709,973

[22] Filed: July 30, 1976

[51] Int. Cl.[2] ..... E02B 3/00; F25C 1/02

[52] U.S. Cl. ..... 61/103; 61/1 R; 61/36 A; 61/86; 62/260

[58] Field of Search ..... 61/103, 50, 36 A, 1, 61/86; 62/260, 259; 175/7, 8, 9; 166/DIG. 1

[56] References Cited

U.S. PATENT DOCUMENTS

| | | | |
|---|---|---|---|
| 3,750,412 | 8/1973 | Fitch et al. | 61/103 |
| 3,842,607 | 10/1974 | Kelseaux et al. | 61/103 |
| 3,863,456 | 2/1975 | Durning | 61/36 A X |

*Primary Examiner*—Jacob Shapiro
*Attorney, Agent, or Firm*—William K. Guest

[57] ABSTRACT

A man-made island and a method for constructing the same in an ice covered body of water using portions of the ice sheet as integral parts of the island. The island is formed by placing fill material, such as sand or gravel, on a portion of the ice sheet to ground that portion. The grounded ice sheet is cut free from the surrounding ice sheet and matter, such as fill material, blocks of ice, etc., is placed on the grounded portion of the ice sheet to construct an island in the body of water. Additional portions of the ice sheet can be separated and grounded on top of previously grounded portions prior to placing matter on the stack of grounded ice pieces to construct the island.

12 Claims, 9 Drawing Figures

ARCTIC ISLAND

BACKGROUND OF THE INVENTION

1. Field of the Invention

This invention relates to a method for constructing an island in an ice-covered body of water using the natural sheet of ice as an integral part of the island.

2. Description of the Prior Art

In shallow water polar regions, which are covered with a sheet of ice at least a part of the year, man-made islands have proven to be an advantageous structure to use as a base for oil-field operations. Such man-made islands have been used as bases for exploratory oil well drilling operations and will be used as well for oil production related operations. To survive the harsh environmental conditions of the arctic, these islands must be protected against erosion and overtopping by waves and storm tides during the summer and, during the winter, they must be able to withstand significant lateral loads exerted by movement of the surrounding sheet of ice.

Islands constructed in shallow water regions off the northern coast of Canada have been built entirely of fill material, such as gravel and silt. Most of those islands were built during the summer while there was no ice cover. At least one was built in winter by removing a section of the sheet of ice which had formed on the body of water and dumping fill material directly on the bottom. These all-fill-material islands have certain limitations. In certain polar regions, a sufficient quantity of fill material is not readily available and must be transported great distances to the island construction site. Moving the vast amount of fill material needed to construct an island great distances in the arctic is very expensive. Even when fill material is available near the island construction site, dredging or mining operations in the arctic are expensive.

SUMMARY OF THE INVENTION

The present invention can be seen to offer a method for constructing an island in polar regions which saves both time and money. This method uses the natural ice cover as an integral part in the construction of the island and thereby lessens the amount of fill material needed.

Briefly, the method of the present invention comprises the step of placing fill material upon the natural ice sheet floating on the body of water until the ice has grounded on the bottom of the body of water. The placing of fill material upon the ice is continued until a working platform of the freeboard, i.e., elevation above the water, and size desired is achieved. It will be preferred to cut the submerged layer of ice free from the surrounding ice either before or after the fill material has grounded the ice sheet.

Another embodiment for constructing an island according to the present invention comprises placing at least enough fill material on a floating piece of ice to overcome its buoyancy, lowering it to the desired location on the bottom of the body of water, moving another floating piece of ice of the desired size above the grounded piece and placing enough fill material on the second piece of ice to sink it on top of the fill material on the first piece of ice. This procedure can be continuously repeated until an island of the desired size and of the desired elevation, up to the water level, has been built. The desired freeboard can be built with additional fill material and ice. Once the island has been constructed, it will be preferred to provide some type of slope protection around the sides of the island to minimize damage to the island caused by erosion and ice features moving against it. To protect against settling, insulation and refrigeration devices, such as heat pipes and air convection piles, can be used to keep the ice layers of the island frozen.

The present invention can be seen to offer significant advantages in the construction of man-made islands in polar regions by using the natural ice cover as an integral part of the island.

DESCRIPTION OF THE PREFERRED EMBODIMENTS

Briefly, the method of the present invention for constructing a man-made island in polar regions comprises the step of placing fill material, which material is denser than the water, upon the naturally-occurring sheet of ice until the sheet of ice is grounded on the bottom of the body of water.

Figure 1:
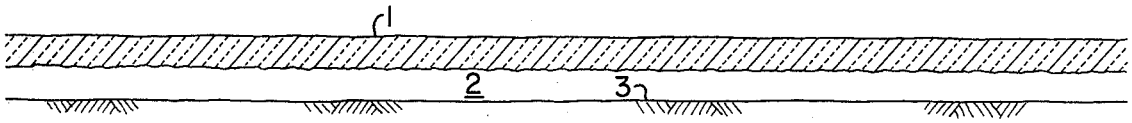
FIGS. 1–4 are elevation views of an arctic body of water and an island in cross-section illustrating the steps of the method of constructing the island according to one embodiment of the present invention.

FIGS. 1 through 4 illustrate the steps of the method according to one embodiment of the present invention. FIG. 1 depicts a typical cross-section of a shallow polar body of water. A sheet of ice 1 is shown floating on top of the body of water 2. The floor or bottom of the body of water is indicated by the numeral 3.

Figure 2:
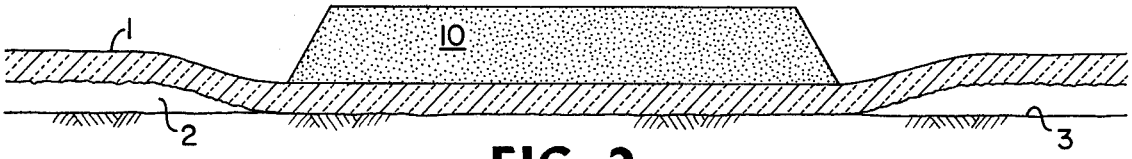

IN FIG. 2, fill material 10 has been placed upon the natural sheet of ice 1 and the weight of the fill material 10 has caused the sheet of ice 1 to bend and ground on the floor 3 of the body of water 2. The fill material will generally have a density greater than that of the body of water and can be a material such as gravel or silt. The fill material can possibly be dredged or mined from nearby locations, or else transported to the island construction site by barge or truck.

Figure 3:
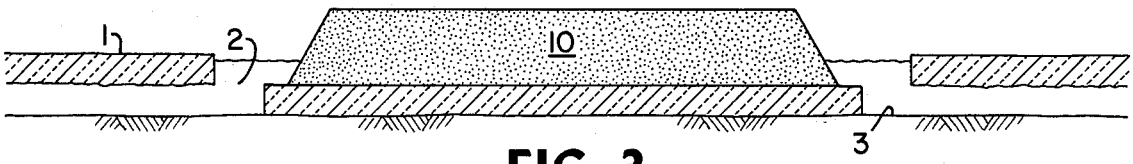

In FIG. 3, the portion of the sheet of ice that is grounded has been cut free from the surrounding sheet of ice. Such cutting of the ice can be done prior to any fill material 10 being placed on the sheet of ice or at any later time.

Figure 4:
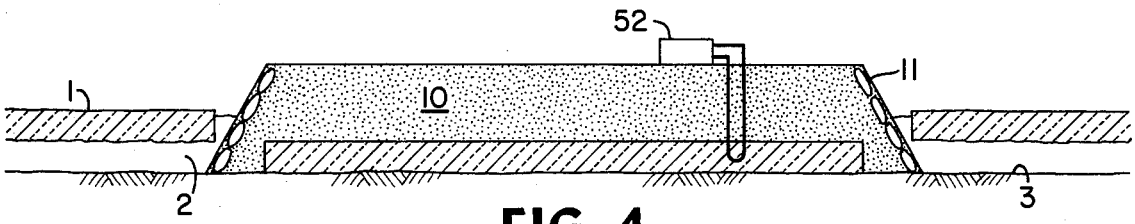

Additional fill material 10 has been placed on the grounded sheet of ice in FIG. 4. The additional fill material 10 has built the island up to achieve the desired working area and freeboard. The sides of the man-made island have been protected to minimize damage to the island caused by erosion and by the surrounding sheet of ice moving against the island by slope protection apparatus 11. The slope protection apparatus 11 can be a number of items including large pieces of rock, sand bags, or a concrete revetment. In circumstances where the island will only be used for a very short time, and the rate of erosion is minimal, it may be acceptable to leave the sides of the island unprotected. It should also be noted that the slope protection apparatus depicted in FIG. 4 is sloped. This slope will assist in breaking up the surrounding ice sheet as it moves against the island. The degree of slope in any specific application will depend on various design and environmental considerations.

Figure 5:
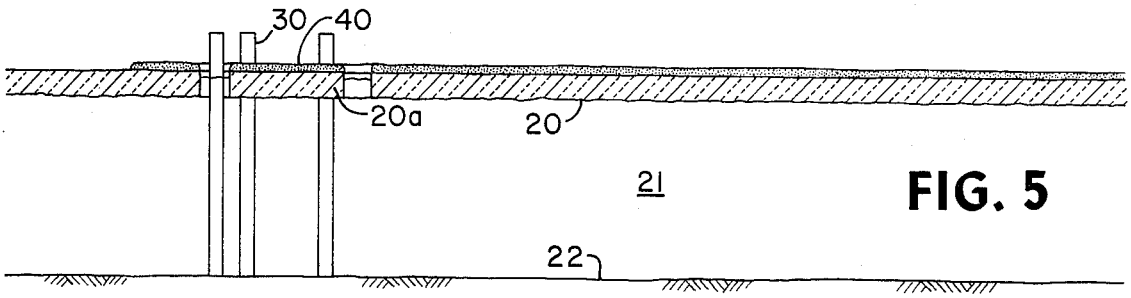
FIGS. 5–9 are elevation views of an arctic body of water and an island in cross-section illustrating the steps of the method of constructing the island according to another embodiment of the present invention.

FIGS. 5 through 9 illustrate another embodiment of the present invention. Depicted in FIG. 5 is a sheet of ice 20 floating on a body of water 21. Piles 30 have been driven into the floor 22 of the body of water 21 to assist in the construction of the island. A thin layer of fill material 40 is placed on the sheet of ice 20. The fill material 40 should generally have a density greater than that of the water 21. Suitable materials would include gravel and silt. The amount of fill material 40 placed upon the layer of ice 20 should preferably be no more than would barely allow the sheet of ice 20 to remain floating at the surface of the body of water 21. Preferably, the fill material 40 is saturated with water and allowed to freeze to bond the fill material 40 to the sheet of ice 20. The cold winter temperatures of the arctic winter will require only a short period of time to freeze the water.

Once the saturated fill material 40 has frozen to the sheet of ice 20, a piece of the ice sheet 20*a* of the desired dimension is cut free from the surrounding sheet of ice 20. The piece of ice sheet 20*a* is positioned over the location where it is to rest on the floor 22 of the body of water 21. Additional fill material 40 is placed upon the piece of ice sheet 20*a* to overcome its buoyancy and sink it.

Figure 6:
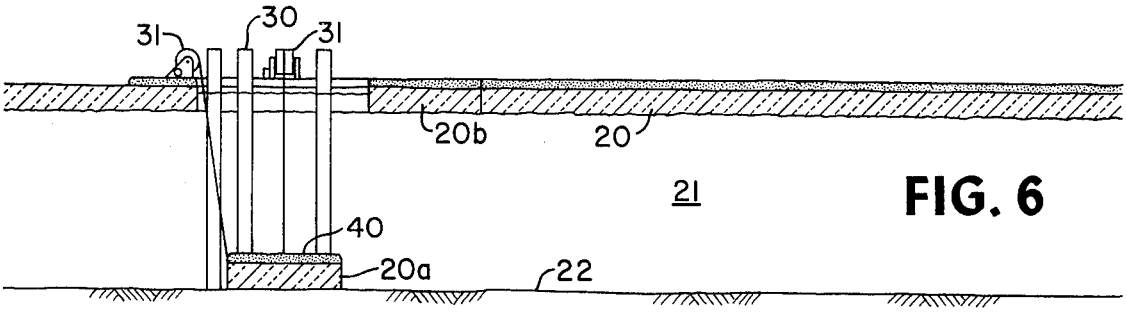
Figure 7:
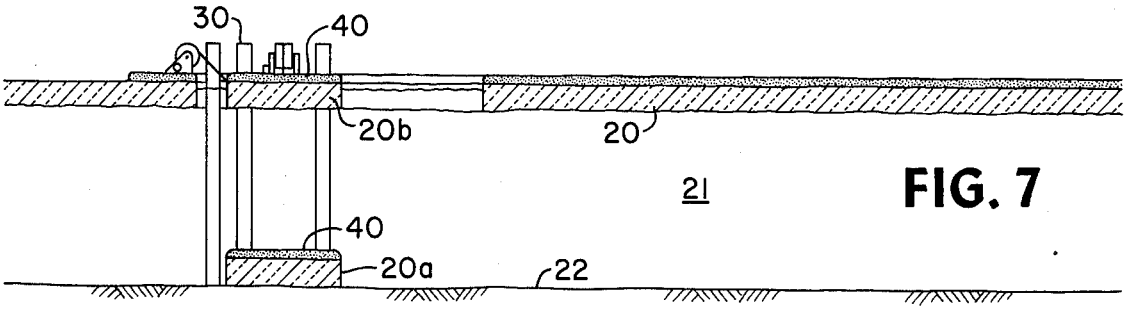
Figure 8:
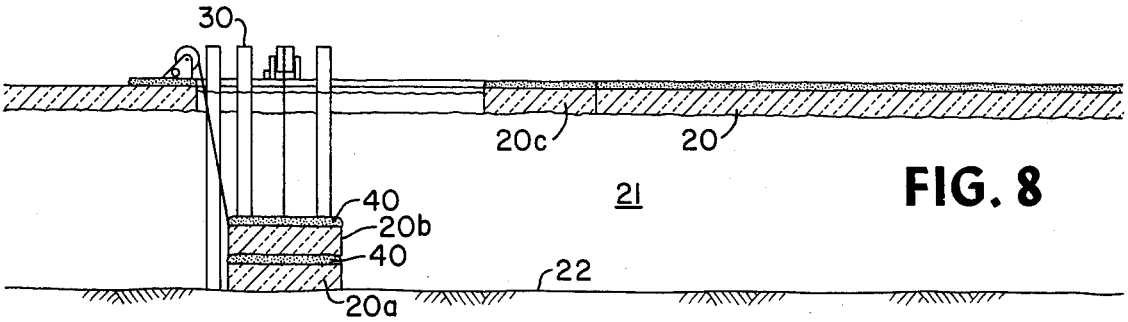

In FIG. 6, the piece of ice sheet 20*a* is being sunk. Piles 30 and winching apparatus 31 are used to control the descent of ice piece 20*a* and guide it to the proper location on the floor 22 of the body of water 21. Then the next piece of ice sheet 20*b* is cut free from the surrounding sheet of ice 20. It is positioned over the first ice piece 20*a,* see FIG. 7. Additional fill material is placed upon the piece of ice sheet 20*b* to overcome its buoyancy. The piles 30 and winching apparatus 31 control the descent of ice piece 20*b* and guide it to the proper location atop fill material 40 on ice piece 20*a,* see FIG. 8.

Figure 9:
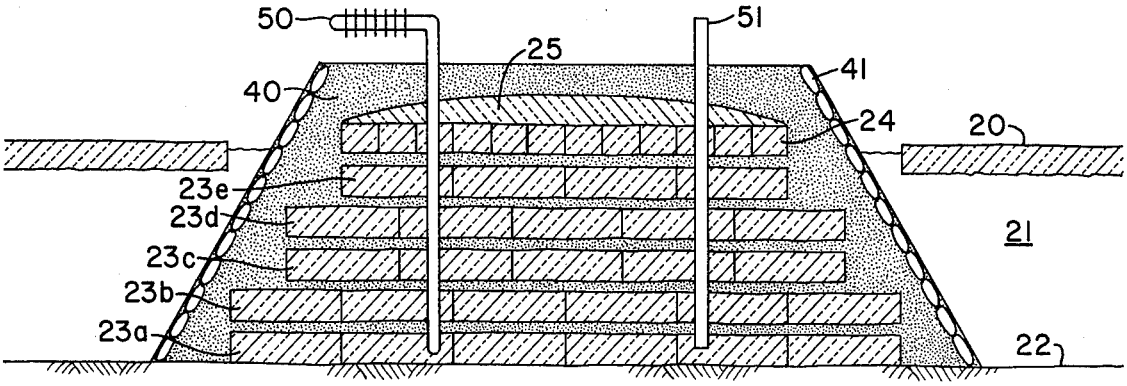

The above enumerated steps are continuously repeated until the stack of ice and fill material has reached the desired elevation above the floor 22 of the body of water 21 or, at most, the surface of the body of water. Any number of stacks can be built next to each other to achieve an island of the desired dimension. As an alternative to stacking each piece of ice directly on top of one other piece, the pieces of ice can be positioned on top of each other in a staggered or offset manner. In FIG. 9, ice pieces 23*a* and 23*b* are stacked with each upper piece being directly on top of each lower piece and ice piece 23*c* is positioned on top of ice piece 23b in a staggered or offset manner.

Once the desired elevation is achieved, or the water line is reached, it will be necessary to add additional matter atop the stack of ice and fill material to form a working area having the desired freeboard. Building the island up above the water line can be accomplished by any number of methods. For instance, fill material can be placed on top of the stack until a working area of the desired dimension and freeboard is achieved. Alternatively, blocks of ice can be cut from the surrounding sheet of ice and placed on top of the stack until the desired working area is constructed. Another alternative would be repeatedly spraying or flooding water on top of the stack and allowing it to freeze. Naturally, it is possible to combine the preceding alternatives to build the island up until it has a working area of the desired dimension and freeboard. FIG. 9 depicts a combination of these three alternatives. A layer of ice blocks 24 have been placed on top of the top ice layer 23*e.* Ice layer 25 was built by repeatedly flooding water on top of the ice blocks 24 and allowing the cold winter temperatures to freeze the water. On top of all this, additional fill material 40 has been placed.

As in the previous embodiment, slope protection 41, such as rocks, sand bags or a concrete revetment, can be placed around the sides of the island to slow erosion of the island and assist in resisting the forces exerted on the island by the surrounding sheet of ice 20 as that ice sheet moves against the island.

If fill material 40 completely covers the ice layers, it will act as insulation and retard the thawing of the ice layers. Even so, in certain circumstances, it may be desirable to install apparatus to keep the ice frozen. Such apparatus would include air convection piles 51, heat pipes 50 (both depicted in FIG. 9) and refrigeration equipment 52 (depicted in FIG. 4). If these units extend a sufficient distance down into the island, they will freeze, and thereby bond, the island to the floor of the body of water to assist the island in resisting the lateral forces exerted on it by the surrounding ice sheet as it moves against the island. The desirability of refrigeration and choice of method will depend on many factors including the amount of insulation surrounding the ice layers, the temperatures of the water and the air and the designed life of the island.

In constructing an island according to the second embodiment, several variations are possible. It may be desirable at times to position the top piece of ice over the stack before placing any fill material on it to insure sufficient clearance between it and the top of the stack. Otherwise, in certain circumstances, the ballast of the layer of fill material on the top piece of ice will increase the ice piece's draft to the point where it will collide with the stack of ice and fill material when an attempt is made to position the top piece above the stack. Along these same lines, each piece of ice could be cut and positioned at the water's surface before any fill material is placed on it. Another variation would be to freeze a thick layer of saturated fill material, which completely overcomes each ice piece's buoyancy, to each piece of ice by supporting the pieces at the surface until the cold air has frozen the saturated fill material.

It can be seen that islands constructed according to the present invention can reduce both the cost and the time of constructing islands by decreasing the needed amount of fill material through the use of the ice sheet as an integral part of the island.

Although this dislcosure is directed to using the natural sheet of ice, nearly any ice formation may be successfully used as an integral part of a man-made island. Other variations and changes may be made in the island and method for constructing it as shown and described herein without departing from the scope of the invention as defined in the claims.

What is claimed is:

1. A method for constructing an island in a body of water having an ice sheet floating thereon which comprises:

placing sufficient fill material having a density greater than the water on a first piece of the ice sheet which is to become an integral part of the island to round the first piece;

separating the first piece from the surrounding ice sheet;

placing an amount of fill material having a density greater than the water on a second piece of the ice sheet which is to become an integral part of the island, said amount of fill material being not more than the amount which allows the second piece of ice to remain floating at the water's surface;

separating the second piece from the surrounding ice sheet;

positioning the second piece over the grounded first piece;

placing additional fill material having a density greater than the water on the second piece to sink it atop the first piece; and placing sufficient matter upon the grounded pieces to construct an island.

2. The method of claim 1 further comprising repeatedly conducting the following steps:

placing an amount of fill material having a density greater than the water on a piece of the ice sheet which is to become an integral part of the island, said amount of fill material being not more than the amount which allows the piece of ice to remain floating at the water's surface;

separating the piece from the surrounding ice sheet;

positioning the piece at the water's surface over the location where it is to be sunk; and placing additional fill material having a density greater than the water on the piece to sink it.

3. The method of claim 1 further comprising saturating the fill material placed on top of each piece and maintaining each piece at the water's surface until the saturated fill material has frozen to the piece.

4. The method of claim 1 further comprising guiding each piece to a precise submerged location with piles and winching apparatus.

5. The method of claim 1 further comprising protecting the sides of the island with slope protection apparatus to minimize damage to the island caused by erosion and by the surrounding sheet of ice moving against the island.

6. The method of claim 1 further comprising refrigerating the pieces which have been sunk to maintain the ice thereof in a frozen state.

7. The method of claim 1 further comprising bonding the island to the bottom of the body of water by freezing the island thereto with refrigeration apparatus.

8. The method of claim 1 further comprising placing blocks of ice upon the grounded pieces to assist in constructing an island.

9. The method of claim 1 further comprising freezing water upon the grounded pieces to assist in constructing an island.

10. The method of claim 1 further comprising placing fill material upon the grounded pieces to assist in constructing an island.

11. An offshore island constructed in a body of water having an ice sheet floating thereon comprising:

a first portion of the ice sheet;

fill material positioned above the first portion of the ice sheet in an amount sufficient to ground the first portion of the ice sheet;

a second portion of the ice sheet positioned above the first portion of the ice sheet and separated therefrom by a layer of fill material; and additional fill material positioned above the second portion of the ice sheet in an amount sufficient to ground the second portion of the ice sheet above the first portion of the ice sheet and result in an island in the body of water.

12. The offshore island of claim 11 further comprising a means for refrigerating the portions of the ice sheet which are integral parts of the island.

* * * * *